US005115867A

United States Patent [19]

Tyler

[11] Patent Number: 5,115,867

[45] Date of Patent: May 26, 1992

[54] DUAL LINEAR FIRE EXTINGUISHER

[75] Inventor: Maurice E. Tyler, Orinda, Calif.

[73] Assignee: Systron Donner, Corporation, Concord, Calif.

[21] Appl. No.: 605,949

[22] Filed: Oct. 30, 1990

[51] Int. Cl.[5] ..... A62C 35/08; A62C 3/08

[52] U.S. Cl. ..... 169/28; 169/58; 169/70; 169/62

[58] Field of Search ..... 169/28, 58, 62, 70; 239/568; 244/129.2, 135 R

[56] References Cited

U.S. PATENT DOCUMENTS

| | | | |
|---|---|---|---|
| 1,760,359 | 5/1930 | Hiss | 169/70 X |
| 3,833,063 | 9/1974 | Williams | 169/28 |
| 4,702,322 | 10/1987 | Richardson | 169/28 |
| 4,834,187 | 5/1989 | Bragg | 169/62 |
| 4,854,389 | 8/1989 | Warren et al. | 169/28 |
| 4,938,293 | 7/1990 | Warren et al. | 169/28 |

FOREIGN PATENT DOCUMENTS

| | | | |
|---|---|---|---|
| 289299 | 11/1988 | European Pat. Off. | 169/28 |
| 390384 | 10/1990 | European Pat. Off. | 169/58 |

*Primary Examiner*—Johnny D. Cherry
*Assistant Examiner*—James M. Kannofsky
*Attorney, Agent, or Firm*—Flehr, Hohbach, Test, Albritton & Herbert

[57] ABSTRACT

A linear fire extinguisher includes a high strength metal elongated tube containing a pressurized fire extinguishant such as Halon 1301. A pair of these tubes are mounted opposite each other with a pair of opposed shaped charges placed along exterior walls opposite each other so that when actuated they provide cutting lines which release the extinguishant in opposed directions so that reaction forces balance out. Concurrently the unwrapping of each container is counteracted and interfered with by the adjacent container to minimize the spread of container fragments. Appropriate intermediate retention of portions of the container is provided to also minimize fragments.

10 Claims, 4 Drawing Sheets

DUAL LINEAR FIRE EXTINGUISHER

The present invention is directed to a linear fire extinguisher and more specifically to a fire extinguisher especially useful for the dry bays of airplane wings containing fuel tanks where the fire extinguisher when explosively cut has only a zero net reaction on the airframe of the aircraft and at the same time flying fragments are minimized.

BACKGROUND OF THE INVENTION

The use of linear fire extinguishers in the form of a high strength, elongated tube containing a pressurized fire extinguishant such as Halon 1301 has been suggested both in U.S. Pat. Nos. 4,854,389 (the '389 patent) and 4,938,293 (the '293 patent), both assigned to the present assignee and both including the present inventor as one of the co-inventors. Here, a flexible linear shaped charge (FLSC) is placed parallel to the axis of the tubular container in close proximity to the container and when detonated cuts the tube to allow for distribution of the fire extinguishant in a very short period of time, e.g., 2 milliseconds. The installation is typically in the dry bay of a military aircraft wing to rapidly extinguish fires due to, for example, a punctured fuel tank. It may also be used in the ullage (empty space) of a fuel cell to prevent overpressures (due to fires, etc.) which would cause structural damage.

As discussed in the '293 patent in order to provide a net reaction force of substantially zero on the tubular container when activated, and thus to minimize stress on the air frame, it has been proposed that a single container be cut on opposed sides simultaneously. This is illustrated in FIG. 3 where container 17 has the opposed shaped linear charges 33*a* and 33*b* located at the interior of the container, diametrically opposed, along the diameter 18. When the shaped charges are detonated they cut along the lines 31*a* and 31*b* which are elements of the cylindrical container 17 and substantially equal opposite reaction forces F1 and F2 are produced which effectively nullify the reaction forces. As illustrated, however, the tube 17 when cut may produce fragments.

OBJECTS AND SUMMARY OF THE INVENTION

It is a general object of the present invention to provide an improved linear fire extinguisher.

In accordance with the above, a linear fire extinguisher for aircraft and similar applications where a rapid distribution of an extinguishant is necessary along a long linear distance comprises a pair of closed, elongated high strength tubular containers each having an axis along which it is elongated, each filled with a pressurized extinguishant, and each including a shaped linear explosive charge for cutting such container along a line parallel to said respective axes, the pair of containers are mounted parallel to each other in close proximity with the linear shaped charges lying on walls of the pair of containers and substantially in the same plane as the axes of said containers, so that when the linear shaped charges are substantially simultaneously detonated, cutting the container along the lines, the walls of the containers will unwrap around interior elements of the containers lying in said plane, the mounting of containers in close proximity counteracts the unwrapping due to the unwrapping walls interfering with one another.

DESCRIPTION OF PREFERRED EMBODIMENTS

Figure 1:
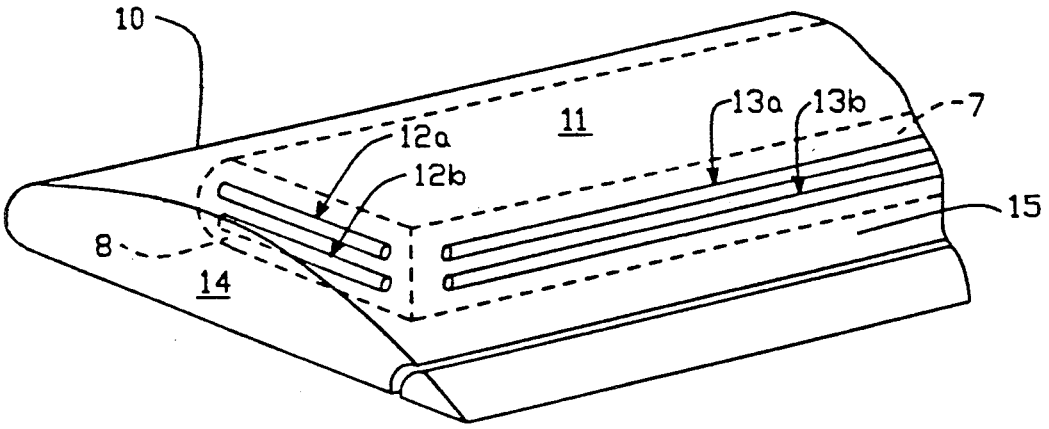
FIG. 1 a perspective view showing the fire extinguisher of the present invention installed in the dry bay of an airplane wing.
Figure 2:
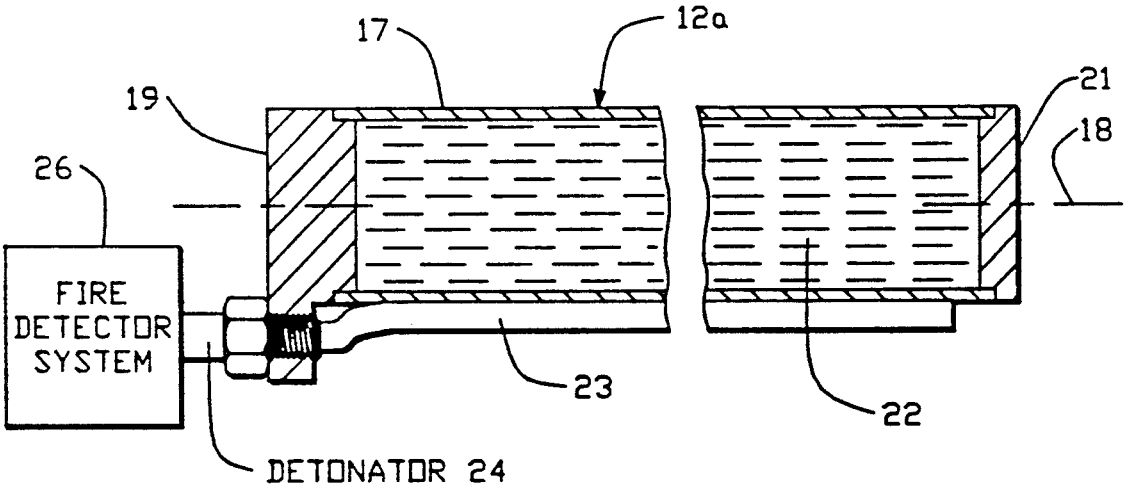
FIG. 2 is a cross-sectional view of a simplified portion of the fire extinguisher showing it connected to a fire detection system.

FIG. 1 illustrates the wing section 10 of an aircraft with a fuel cell 11 shown in dashed outline. The walls 7 and 8 of the fuel cell necessarily are attached to or formed as a part of the wing airframe section 10. The unoccupied portions 14, 15 of the wing are known as dry bays. Attached to walls 7 and 8 are linear fire extinguishers 12 and 13 incorporating the present invention. Each extinguisher includes a pair of pressurized containers, one of which, 12*a* for example, is illustrated in FIG. 2. As discussed above, the containers could also be installed in the ullage of a fuel cell.

The invention, of course, has other applications as for example, an engine compartment of an aircraft or a land vehicle; in fact, in other than aircraft application where it is desired to immediately extinguish fires where, at the same time, it is desired to minimize impulse loads on the supporting structure.

Figure 3:
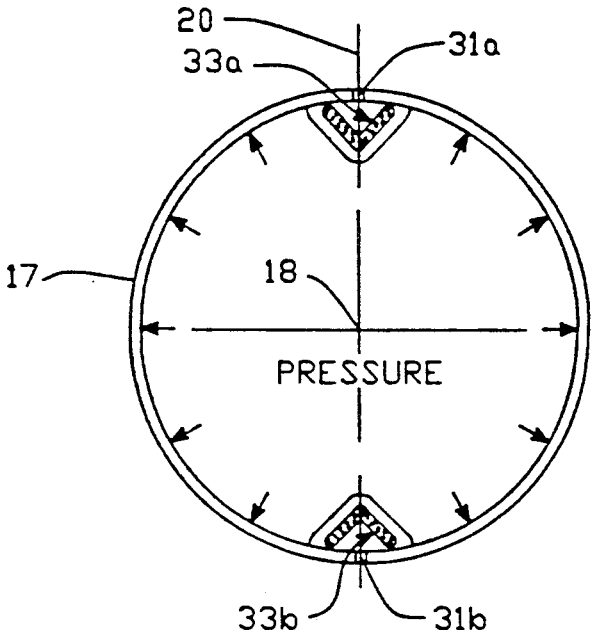
(PRIOR ART) FIG.—3
FIG. 3 is a prior art showing of a zero force fire extinguisher which is a perspective view of a cross section of a tubular container similar to FIG. 2 but with a pair of opposed flexible linear shaped charges located on the interior wall of the container.

Now referring to the example of a single pressurized container 12*a*, one of a pair which will below which includes a welded tubular container 17 constructed of high strength metal. It is elongated along the axis 18 and is closed at the ends 19 and 21. Thus, pressures of several thousand psi may be applied by pressurizing the Halon 1301 liquid with nitrogen. Extending along and attached on the outside wall of tube 17 parallel to axis 18 is a flexible linear shaped charge (FLSC) 23 which when actuated by a detonator 44 (actuated by fire detector system 26) is capable of cutting through the entire wall thickness of container 17. The extinguishant under pressure is then rapidly discharged within a few milliseconds into the hazard area. All of the foregoing is described and claimed in the above '389 patent. As illustrated in FIG. 3, the FLSC may be mounted in the interior of the container.

Figure 4:
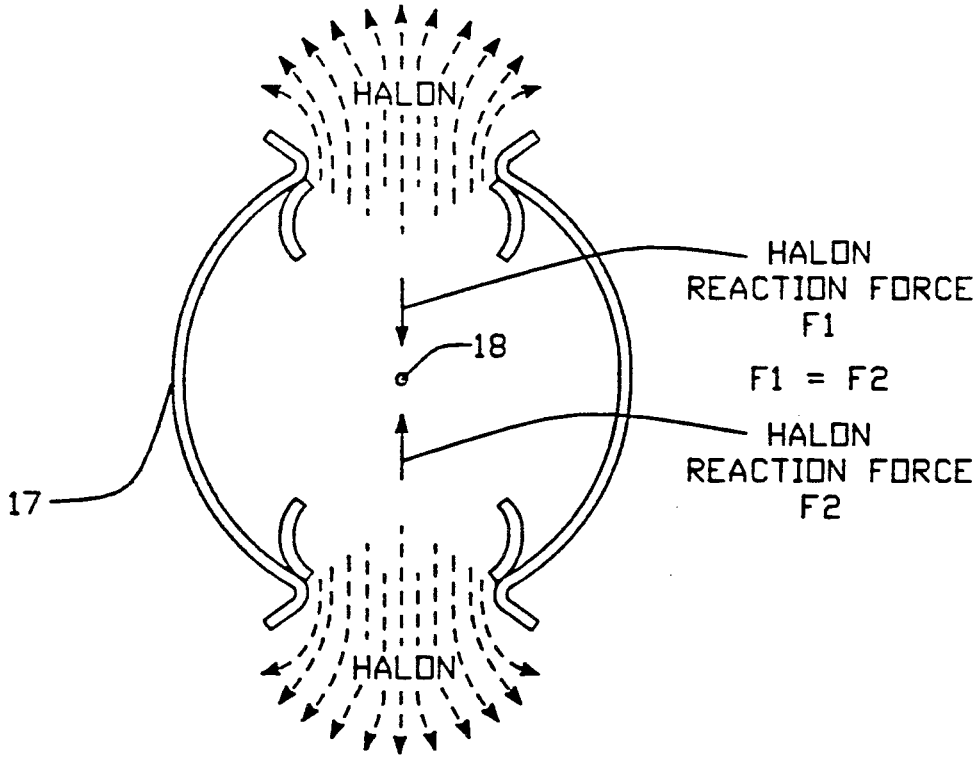
(PRIOR ART) FIG.—4
FIG. 4 is a cross-sectional view showing FIG. 3 after it is opened.

The linear shaped charge which might typically be sold under the trademark "JETCORD", may cut the cylinder wall in a time interval measured in microseconds. Thus, the impulse or reaction force of a single tube or container 12*a* as shown in FIG. 2 may be quite high. This is the reason for the use of opposed shaped charges 33*a* and 33*b*3, as illustrated in FIG. 3, to provide a nullification of these reaction forces F1 and F2 as shown in FIG. 4. This concept of nullification of forces is disclosed and claimed in the '293 patent.

Figure 5:
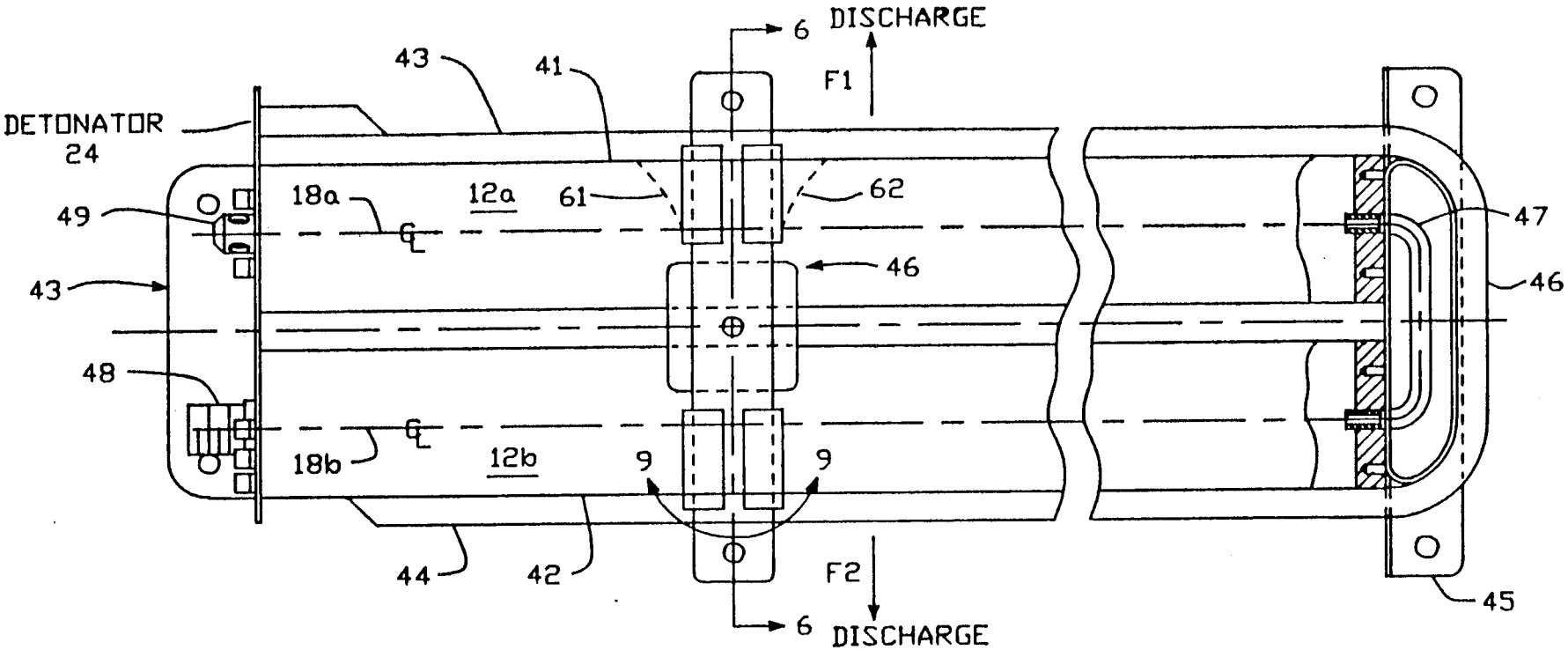
FIG. 5 is a topview enlarged and in more detail showing one of the linear fire extinguishers embodying the present invention as more simply illustrated in FIG. 1.

In accordance with the present invention as illustrated in FIG. 5, a pair of tubular fire extinguishers 12*a* and 12*b* are mounted adjacent each other in close proximity, e.g., from touching to ½ inch. Each includes respective high pressure tubular containers 41 and 42 which are mounted at their ends by the bracket 43 at the left end and the bracket 44 at the right end. The axis or center line of container 41 is designated as 18*a* and of 42 as 18*b*. The mounting is such that the shaped charges located on the exterior wall (alternatively interior) of each container 41 and 42 are in substantially the same plane as the axes 18*a*, 18*b*; namely, on container 41 there is the linear charge 43 and on container 42 the linear charge 44. In fact, these are portions of the same linear charge to form a continuous loop and are interconnected as illustrated at 46. Thus, a U-shaped unbroken continuous loop is formed whereby detonation by detonator 24 propagates at microsecond speeds to the other end. In other words, in effect, the containers 41 and 42 are substantially cut open at the same time for all practical purposes, the extinguishant under pressure outflows in perhaps 1 to 2 milliseconds. For example, for a 24 inch long unit, as illustrated in FIG. 5, total propagation time might be, for example, 5 microseconds. Containers 41 and 42 also have their pressures equalized by the interconnection 47. For shipping purposes, at the left end there is a pressure sensing unit 48 and a pressure release valve 49 respectively at the ends of containers 42 and 41.

Figure 6:
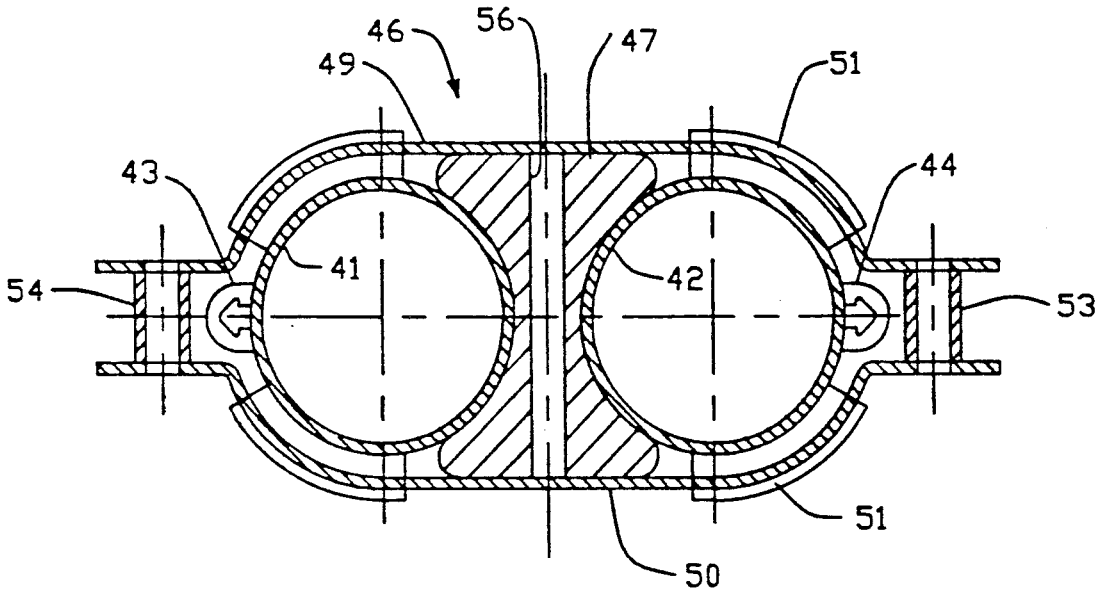
FIG. 6 is a cross-sectional view taken along line 6—6 of FIG. 5.

As also better illustrated in FIG. 6, retaining means 46 for retaining intermediate portions of the containers 41 and 42 are provided when they are being explosively cut. Referring to both of FIGS. 5 and 6, the retaining means for a 24-inch long device, as illustrated in the preferred embodiment of FIG. 5, would have two sets of intermediate retainers 46.

Referring to the specific construction of a preferred embodiment of one type of retainer as shown in FIGS. 5 and 6, it is in the form of a bracket having a plastic spacer 47 with concave sides to fit the containers 41 and 42. Upper and lower straps 49 and 50 are provided with appropriate resilient collars 51. The bands 49 and 50 are coupled at 53 and 54. The spacer 47 may include an aperture 56 for the purposes of mounting to, for example, the fuel tank wall 8 shown in FIG. 1. A mounting clamp or bracket with the desired cushioning is available from T. A. Mfg. Corp. of Glendale, Calif., such cushioning being illustrated in U.S. Pat. No. 3,856,245.

A second technique of retaining the containers 41 and 42 by intermediate portions (other than the left and right ends as supported by brackets 43 and 46) is provided by a simple thin semi-rigid sheet 57 which is non load absorbing. Here the sheet may run the length of the axes of the tubes 41 and 42 and the tubes may be, for example, attached by saddle clamps (not shown) to the sheet 57.

Figure 7:
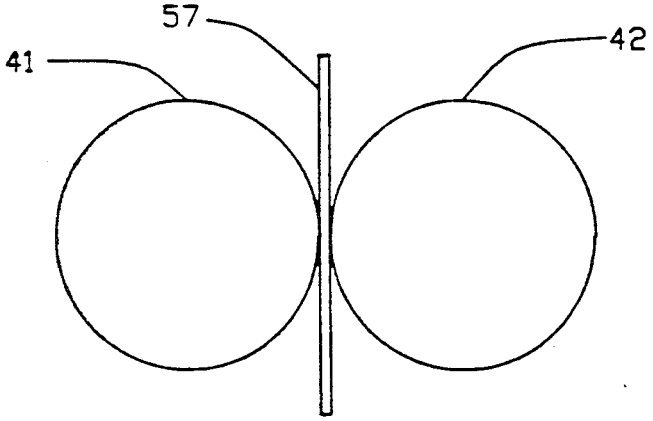
FIG. 7 is a simplified cross-sectional view of an alternative embodiment of FIG. 6.
Figure 8:
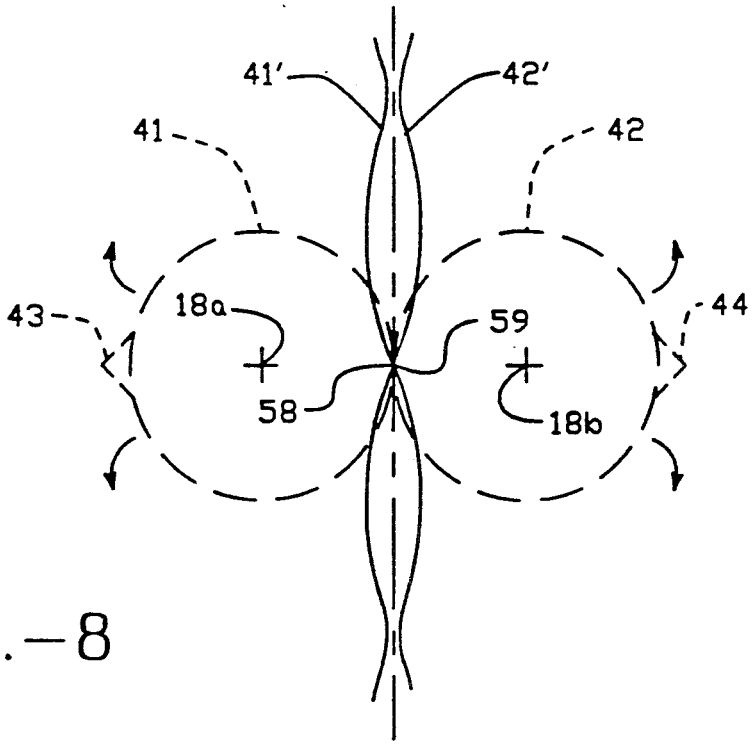
FIG. 8 is cross-sectional view showing the embodiments of FIG. 6 or 7 when exploded or opened.

Both of the above intermediate retaining techniques will retain at least a portion of the container walls during the explosive cutting as illustrated in FIG. 8. Here containers 41 and 42 are shown in dashed lines before being cut with their respective shaped charges 43 and 44. Then when this looped shaped charge 43, 44 is actuated, the walls of containers 41 and 42 both unwrap substantially simultaneously around interior elements or longitudinal lines 58 and 59 into the position shown in FIG. 8 as 41' and 42'. It is noted that the elements 58 and 59 lie substantially in the same plane as the axes 18*a* and 18*b* and also the shaped charges 43 and 44. Unwrapping of the walls of the containers 41 and 42, as is quite apparent, is interfered with or stopped substantially in a plane perpendicular to the plane defined by axis 18*a*, 18*b*. The unwrapping is stopped due to the interference of one unwrapped wall with another. Thus this is a significant factor in preventing the walls of the containers 41 and 42 from turning into fragments to cause further harm. Moreover, the unwrapped walls 41' and 42' are further retained because of the intermediate retention of the flexible sheet 57 (FIG. 7) which prevents the walls from further movement or the retention clamp of FIG. 6.

Figure 9C:
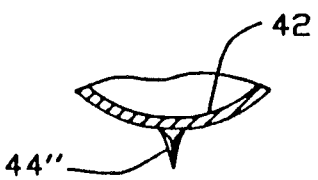
FIG. 9C is a cross-sectional view similar to FIG. 9B but of another embodiment.
Figure 9B:
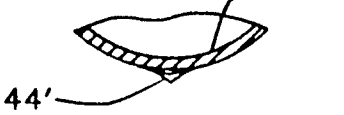
FIG. 9B is a cross-sectional similar to FIG. 9A but of another embodiment also taken along the line 9—9 of FIG. 5.
Figure 9A:
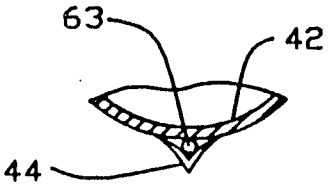
FIG. 9A is a cross-sectional view taken along the line 9—9 of FIG. 5 showing one embodiment of the interruption of a linear shaped charge.

Referring to the details of the unwrapping when the retention clamps of FIG. 6 are used and specifically referring to FIG. 5, the unwrapping will occur along the typical cut lines 61 and 62 as shown in the case of the container 41. Moreover, to insure that the clamp itself is not explosively destroyed so that its components become fragments, the shaped charge in the proximity of the clamp is interrupted or disabled. This may be accomplished as illustrated in FIG. 9A where there is a short segment of welding rod 63 (or rubber O-ring stock) which spoils the shape of the charge so that it will not cut. In the alternative of FIG. 9B, the shaped charge 44 is merely squashed or flattened as shown at 44' so that it will not cut but yet still propagate; finally, FIG. 9C at 44'' shows a squeezed together segment.

In addition to minimizing the production of fragments, the present invention concomitantly provides a zero force structure. As illustrated in FIG. 5, the directions of discharge labelled with the forces F1 and F2 equalize each other in the same manner as illustrated in FIG. 4. In addition, besides nullifying reaction forces and minimizing fragments, the total construction is still relatively lightweight (which is especially critical in aircraft applications) since no covering or housing is necessary. Alternatively in some applications a fiberglass wrapping could be applied to portions of the structure in a manner so as not to interfere with the dispersion of extinguishant.

What is claimed is:

1. A linear fire extinguisher for aircraft and similar applications where a rapid distribution of an extinguishant is necessary along a long linear distance comprising:

a pair of closed, elongated high strength tubular containers each having an axis along which it is elongated, each filled with a pressurized said extinguishant, each including a shaped linear explosive charge means for cutting such container along a line parallel to said respective axes, means for mounting said pair of containers parallel to each other in close proximity with said linear shaped charges lying on walls of said pair of containers and substantially in the same plane as the axes of said containers, means for simultaneously detonating said shaped linear charges, said means for cutting the containers along said lines comprising means for allowing the walls of said containers to unwrap around interior elements of said containers, and wherein said means for mounting said containers in close proximity comprises means for counteracting said unwrapping which comprises means for allowing said unwrapping walls to interfere with one another.

2. A fire extinguisher as in claim 1 wherein said shaped linear charges are portions of an unbroken continuous two ended loop where detonation at one end of the loop propagates at microsecond speed to the other end.

3. A fire extinguisher as in claim 1 including means for interconnecting said two pressurized containers for equalizing pressure.

4. A fire extinguisher as in claim 1 where said shaped linear charges, when detonated, comprise means for causing opposite forces which substantially nullify each other.

5. A fire extinguisher as in claim 1 including means for retaining intermediate portions of containers during said unwrapping.

6. A fire extinguisher as in claim 5 where said retaining means includes a semi-rigid sheet to which said containers are fastened at said interior elements.

7. A fire extinguisher as in claim 5 wherein said retaining means includes a plurality of brackets around said containers spaced from one another.

8. A fire extinguisher as in claim 7 including means for interrupting the explosive effect of said linear charge in the proximity of said brackets.

9. A fire extinguisher as in claim 8 where said interrupting means includes a welding rod-like segment inserted in said shaped charge.

10. A fire extinguisher as in claim 8 where said interrupting means includes a deformed portion of said shaped charge.

* * * * *